US006907831B1

(12) United States Patent
Rising

(10) Patent No.: US 6,907,831 B1
(45) Date of Patent: Jun. 21, 2005

(54) PHOTOLYTIC METHOD OF IMPROVING MERCURY CAPTURE IN FOSSIL (COAL) FIRED SYSTEMS

(75) Inventor: Bruce Rising, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/733,744

(22) Filed: Dec. 11, 2003

(51) Int. Cl.[7] ..... F23J 15/02
(52) U.S. Cl. ..... 110/345; 110/203
(58) Field of Search ..... 110/203, 346, 110/347, 342, 345; 204/157.2, 157.3

(56) References Cited

U.S. PATENT DOCUMENTS

| | | | | |
|---|---|---|---|---|
| 3,869,362 | A | | 3/1975 | Machi et al. |
| 3,984,296 | A | | 10/1976 | Richards |
| 4,097,349 | A | | 6/1978 | Zenty |
| 4,146,450 | A | | 3/1979 | Araki et al. |
| 4,416,748 | A | | 11/1983 | Stevens |
| 4,995,955 | A | | 2/1991 | Kim et al. |
| 5,144,146 | A | | 9/1992 | Wekhof |
| 5,489,777 | A | | 2/1996 | Stedman et al. |
| 5,569,436 | A | * | 10/1996 | Lerner ..... 422/170 |
| 5,787,823 | A | * | 8/1998 | Knowles ..... 110/344 |
| 6,346,419 | B1 | | 2/2002 | Ryerson et al. |
| 6,495,108 | B1 | | 12/2002 | Rising |

OTHER PUBLICATIONS

Olson et al., Mechanisms of Mercury Capture and Breakthrough on Activated Carbon Sorbents, Symposia Preprint, Aug. 20–23, 2000, American Chemical Society—Division of Fuel Chemistry, 220th ACS National Meeting, vol. 45, No. 4.

Dr. Steven Benson, Effect of NO2 Concentration on HG0 Capture with Activated Carbon, Handout given during American Chemical Society—Division of Fuel Chemistry, 220th ACS National Meeting,, Aug. 2000.

* cited by examiner

*Primary Examiner*—Kenneth Rinehart

(57) ABSTRACT

A combustion-based system and related method includes a combustor for burning a combustible material, wherein an exhaust gas stream output by the combustor includes $NO_2$ and at least one metal including mercury. An ultraviolet light source is in optical communication with the exhaust gas stream. Ultraviolet light from the light source photochemically dissociates at least a portion of the $NO_2$ to form an $NO_2$ reduced exhaust stream. A sorbent containing filter media receives the $NO_2$ reduced exhaust stream and as a result of the reduction in $NO_2$ provides improved trapping efficiency of mercury.

17 Claims, 3 Drawing Sheets

PHOTOLYTIC METHOD OF IMPROVING MERCURY CAPTURE IN FOSSIL (COAL) FIRED SYSTEMS

FIELD OF THE INVENTION

The invention relates to a system and method for reducing a mercury emissions from systems having combustion sources, including fossil fired power plants or waste incinerators using photolytic techniques.

BACKGROUND OF THE INVENTION

Coal is a commonly used fuel in power generating systems. It is also commonly used in pulverized fuel facilities, and in Integrated Gas Turbine Combined Cycle (IGCC) facilities. However, coal is one of the most impure fuels having impurities that range from trace quantities of many metals, including mercury, small quantities of uranium and thorium, to much larger quantities of aluminum and iron, to still larger quantities of impurities such as sulfur.

Mercury is a toxic material and is released into the atmosphere when coal, or any combustible material (such as a hazardous waste) that may contain mercury, is burned. It has been estimated that approximately 50 tons of mercury are introduced into the environment every year in the US and several thousand tons annually worldwide, a significant portion of it originating from coal fired power plants. Accordingly, there is substantial pressure to reduce the emissions of mercury from coal burning plants.

Some of this mercury is believed to be present in the form of $HgCl_2$, some as elemental mercury vapor ($Hg^0$), and some in different oxidation states. The amount of elemental mercury vapor present varies widely. Concentrations can range from 1 ppb to 1 ppm.

The combustion gas can contain a mixture of $CO_2$, $O_2$, NO, $NO_2$, $SO_2$, CO, $H_2O$, and various toxic metals including mercury. The mechanism of mercury capture on a high surface area sorbent may be influenced by the presence of one or more other combustion by-products, such as disclosed in "Mechanisms of Mercury Capture and Breakthrough on Activated Carbon Sorbents" by Edwin S. Olson, Grant E. Dunham, Ramesh K. Sharma, Stanly J. Miller, Energy and Environmental Research Center, University of North Dakota, Grand Forks, N. Dak., 58202, American Chemical Society, $220^{th}$ National Meeting, Aug. 20–24, 2000, preprint No. 4 Vol. 25.

One technique proposed for controlling mercury release is to inject a high surface-area adsorbent into the exhaust gas path, then to capture the sorbent on a filter bed, such as a baghouse or similar filter media. This process shows some merit, with theoretically high degrees of mercury capture. However, test results have shown inhibition of the process due to the $NO_2$ in the exhaust gas preventing the uptake of mercury vapor by the sorbent media.

SUMMARY OF THE INVENTION

This invention utilizes the photoytic dissociation of $NO_2$ to enhance the capture (mitigation) of mercury released from a combustion process. A combustion-based system includes a combustor for burning a combustible material, wherein an exhaust gas stream output by the combustor includes $NO_2$ and at least one toxic metal including mercury. Although mercury will generally be accompanied by other metal species, systems and methods according to the invention work with or without the presence of extraneous metals or non-metals in the combustion gas. Because of its vapor pressure, mercury in the exhaust stream is expected to be in the vapor phase. At least one ultraviolet light source is in optical communication with the exhaust gas stream. Ultraviolet light from the light source photochemically dissociates at least a portion of the $NO_2$ to form an $NO_2$ reduced exhaust stream by converting $NO_2$ into NO and ½ $O_2$. A sorbent injection device and filter system, or a sorbent containing filter media receives the mercury and the $NO_2$ reduced exhaust stream downstream of the light source. As a result of the photolytic conversion of $NO_2$ into NO and $O_2$, the system provides improved trapping efficiency of mercury and thus emits an exhaust stream having a reduced mercury concentration into the atmosphere.

The system can be a fossil fuel fired power plant, such as a coal fired plant. The system can also be a waste incinerator. The system can include a particle collection device for trapping the sorbent. The sorbent media can include activated carbon, charcoal, or similar high-surface area filter media. The sorbent media can be incorporated into the filter bed, or injected upstream of the filter bed where it can react with the combustion gases prior to filtration. The ultraviolet light source preferably provides light in a wavelength range of 350 to 400 nm.

The system can reduce the amount of $NO_2$ in the exhaust gas to below 20 parts per million, such as 10 parts per million, and also operate exclusive of catalytic materials.

The light source can be disposed in the exhaust gas stream or disposed remote from the exhaust stream. In the remote embodiment, an optical fiber network can transmit the ultraviolet light generated into the exhaust stream.

A method for reducing mercury emissions from combustion-based systems includes the steps of irradiating an exhaust gas stream including mercury and $NO_2$ with ultraviolet light, the light photochemically dissociating at least a portion of the $NO_2$ to form a gas stream having reduced $NO_2$. The $NO_2$ reduced gas stream is contacted with a sorbent material, wherein the sorbent material traps the mercury.

BRIEF DESCRIPTION OF THE DRAWINGS

A fuller understanding of the present invention and the features and benefits thereof will be accomplished upon review of the following detailed description together with the accompanying drawings, in which.

DESCRIPTION OF PREFERRED EMBODIMENTS

It has been found that the capture efficiency of high surface area sorbents, such as activated carbon, for metals including mercury, is significantly degraded by exposure to $NO_2$. Because of its toxic nature, regulatory agencies are concerned about the release of mercury into the environment. Upon suitable irradiation, $NO_2$ is readily dissociated into NO and $O_2$. Through reduction in the $NO_2$ concentration in the exhaust stream, the chemical capacity of the sorbent to scavenge mercury is improved, thus reducing the mercury concentration is the exhaust gas stream released into the atmosphere.

In a pulverized coal-based combustion systems, $NO_x$ emissions can be very high, such as 500 ppm, with as much as 10–15% of this $NO_x$ being $NO_2$. In any new installation, and for many older units, an SCR (Selective catalytic reduction) system is often installed to reduce $NO_x$ emissions. An SCR utilizes ammonia vapor as the reducing agent and is injected into the flue gas stream, passing over a catalyst. $NO_x$ emission reductions over 80–90% are generally achieved. But even using post combustion control methods to reduce $NO_x$, the residual concentration in the flue gas can be over 50 to 60 ppm, with as much as 25 ppm being $NO_2$ and possibly as much as 50 ppm.

As noted in the background, one method to reduce mercury emissions is to inject a finely divided powder, such as activated carbon in the exhaust path. With a high surface area this material adsorbs mercury on its surface as the gases pass over and around the sorbent particles. The powder is then captured on a filter media some distance downstream from where the sorbent is injected. However, sorbents designed to capture mercury, such as activated carbon, are also found to adsorb $NO_2$ present in the exhaust gas. There is significantly more $NO_2$ in the exhaust gas than mercury, and it has been found that $NO_2$ can rapidly build up on the adsorbent surface, deactivating surface sites on the sorbent allowing mercury to pass through the filter system virtually unabated.

Figure 1:
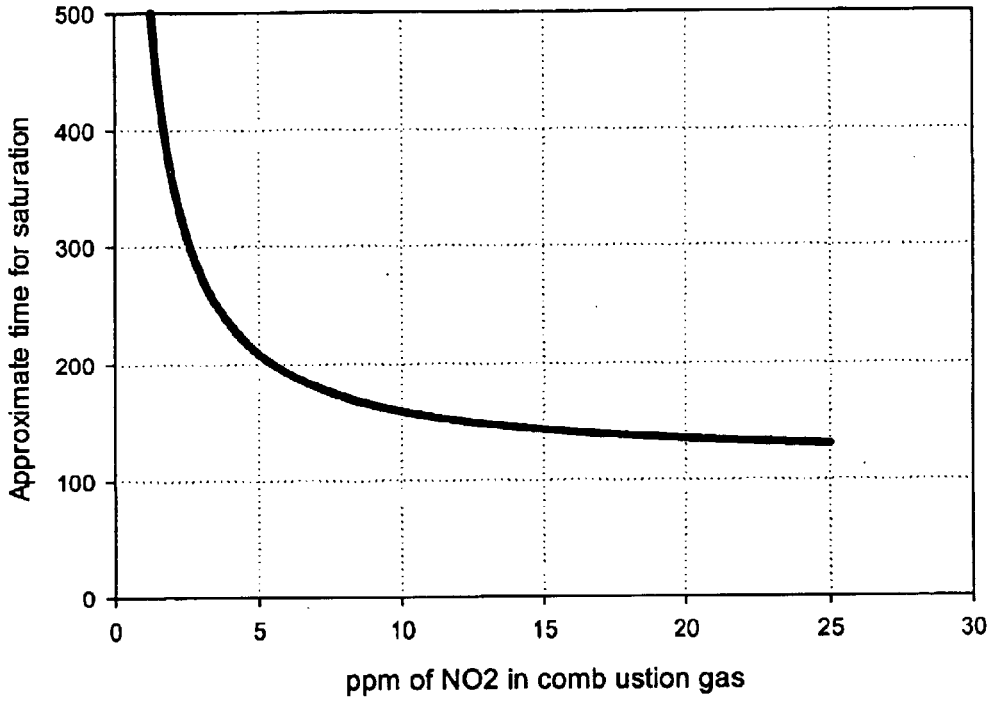
FIG. 1 shows the impact of $NO_2$ on sorbent saturation showing the time before breakthrough in a mercury capture process using a sorbent media.

FIG. 1 shows the impact of $NO_2$ concentration on the time before mercury breakthrough in a mercury capture process using an activated carbon sorbent media. The concentration of $NO_2$ was varied from 0 to 25 ppm. The temperature of the combustion gas ranged from 100° C. to 150° C. In a $NO_2$-free or near $NO_2$-free environment (<2 ppm), the time for sorbent saturation (mercury breakthrough) is in excess of 500 minutes, up to several days. However, as the $NO_2$ concentration is increased, the time for sorbent saturation (mercury breakthrough) begins to rapidly decrease.

The invention takes advantage of the low bonding energy that exists between the NO molecule and the additional oxygen (O) atom in the $NO_2$ molecule. Specifically, the bond dissociation energy of the NO—O bond is 305 kJ/kg-mole. This bond energy is low in comparison to other species present in the exhaust stream, such as $CO_2$ and $N_2$. Using the conversion $E=1.2\times10^{-4}$ kJ/mole/lambda, where lambda is in meters, 305 kJ/Mole corresponds to a wavelength of 393 nm.

Figure 2:
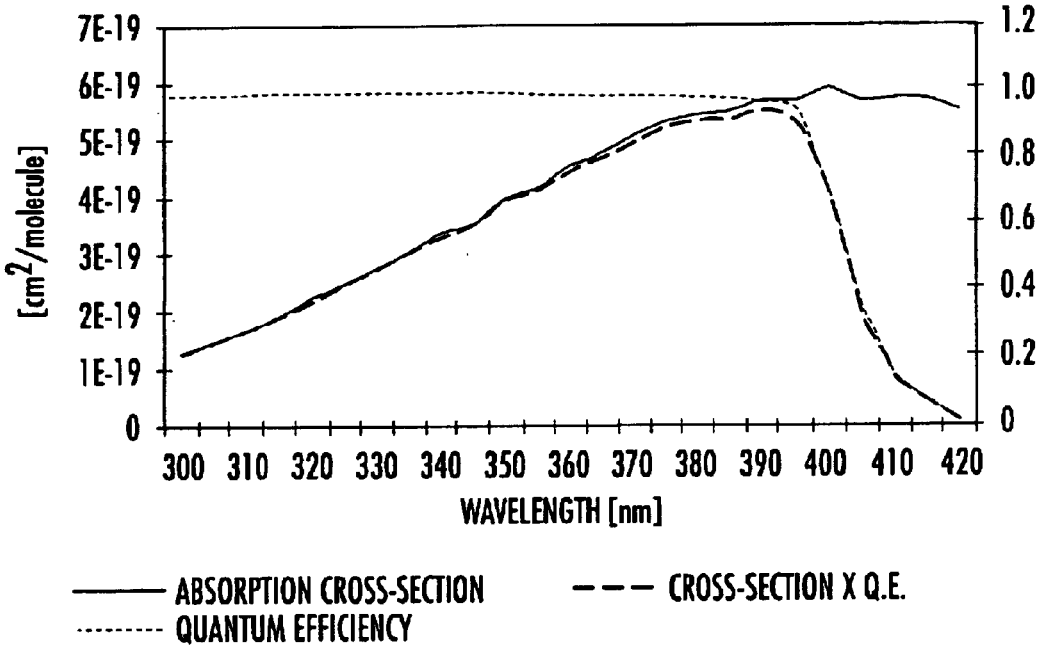
FIG. 2 is a plot which shows the efficiency of $NO_2$ absorption for UV light and thus its ability as a function of wavelength to dissociate into NO and oxygen. Peak efficiency can be seen to occur at about 380–395 nm.

FIG. 2 is a plot which shows the efficiency of $NO_2$ absorption for UV light and thus its ability as a function of wavelength to dissociate into NO and oxygen. Peak efficiency can be seen to occur at about 380–395 nm. The efficiency above this wavelength range drops very quickly, primarily due to the loss of the efficiency of a specific photon to be absorbed per molecule (quantum efficiency).

Thus, a UV source with strong emission between 350 and 400 nm, and preferably between 380 and 395 nm, would be appropriate for dissociating $NO_2$. Use of wavelengths between 350–400 nm also decrease undesirable secondary reactions, such as the formation of ozone which can occur at around 220 nm, for example.

Above a $NO_2$ concentration of 25 ppm, which is generally present in the exhaust stream of many fossil fuel fired power plants, the adsorption efficiency of the $NO_2$ for UV light has been found to be very high. Therefore, $NO_2$ dissociation though irradiation can be quite rapid.

Figure 3:
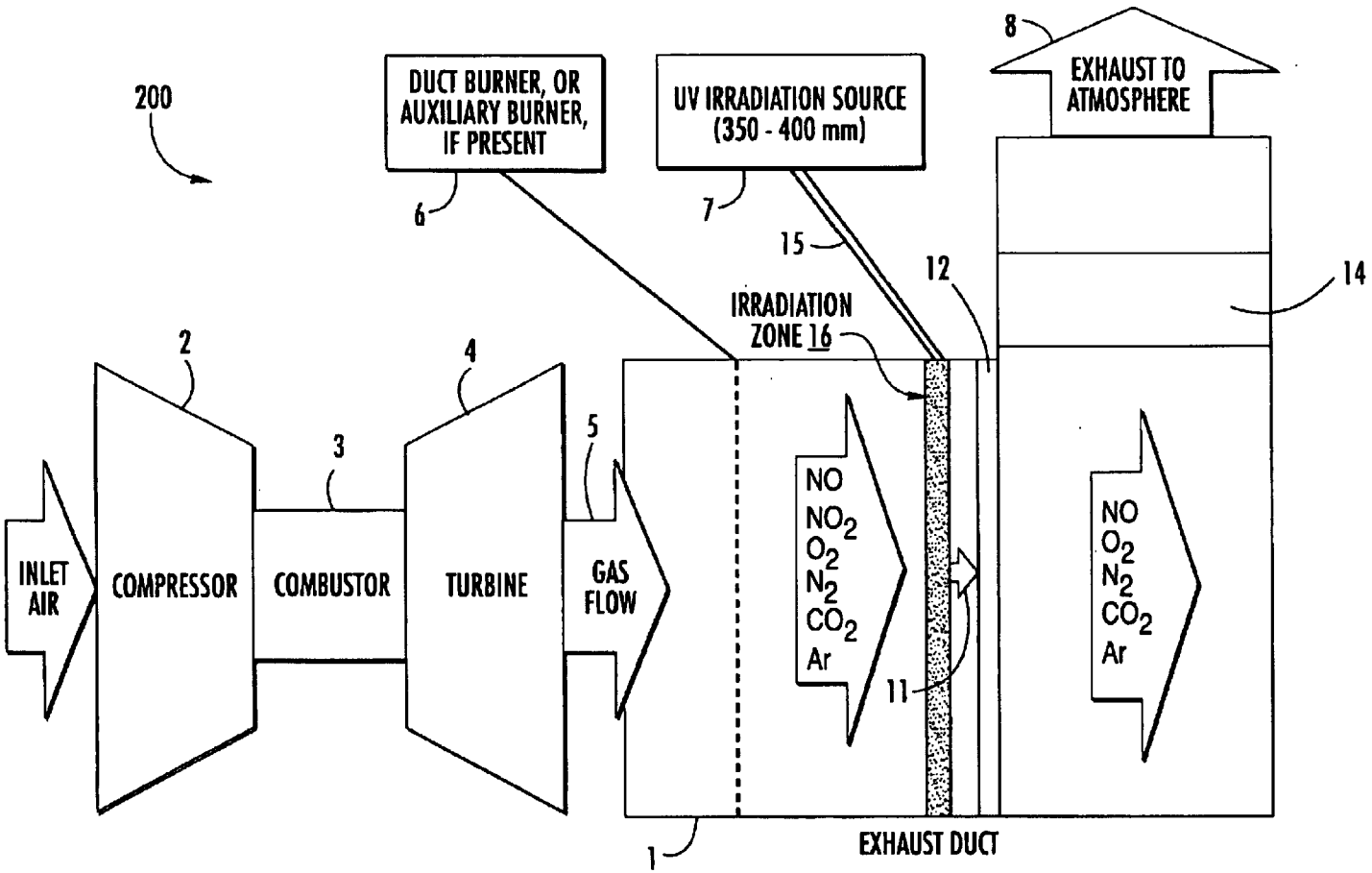
FIG. 3 illustrates a combustion-based system including at least one ultraviolet light source in optical communication with the exhaust gas stream, according to an embodiment of the invention.

The invention is a post-combustion control process, that can be used in any system where mercury is present in a hot exhaust gas stream. A combustion-based system 200 according to an embodiment of the invention is shown in FIG. 3. System 200 is a gas turbine equipped facility, including a compressor 2, combustor 3 and turbine 4, for processing a fossil fuel. An exhaust gas stream 5 output by the combustor 3 includes $NO_2$ and at least one metal including mercury. Although shown as a gas turbine equipped facility, system 200 can be a pulverized fuel combustion system, an IGCC power plant, or any chemical processing plant including an incinerator which releases $NO_2$ along with mercury into the environment. The primary power plant can include an auxiliary burner 6, which generally generates additional $NO_x$.

At least one ultraviolet light source 7 is disposed in optical communication with the exhaust gas stream. Ultraviolet light from the light source 7 photo-chemically dissociates at least a portion of the $NO_2$ in irradiation zone 16 into NO and $O_2$ to produce an $NO_2$ reduced exhaust stream 11. A high surface area sorbent containing filter 12 receives the $NO_2$ reduced exhaust stream 11 and adsorbs the mercury and other heavy metals that may be present, such as arsenic or selenium. Although system 200 incorporates the sorbent media into filter 12, the sorbent can also be injected upstream of the filter 12 where it can react with the combustion gases prior to filtration. The high surface area sorbent can be activated carbon, or similar material, or even coal ash. The mercury, sorbent, and ash are all trapped by a particulate collection device 14, such as a conventional baghouse, which is generally already part of the normal emission control package provided by most power plants and related facilities.

The light source 7 can be one or more lamps which can be located within the exhaust duct and/or stack 1 (hereafter duct/stack 1), or alternatively disposed remote to the duct/stack 1 and optically coupled thereto. Mercury vapor lamps are one class of light source that produces the preferred wavelength range of light, although other irradiation sources such as lasers or other high-energy sources may be used.

When the light source 7 is disposed in the duct/stack 1, cooling and maintenance of the lamps may be required depending upon the exhaust gas conditions and the location of the light source 7. FIG. 3 shows light source 7 disposed remote to duck/stack 1. In this arrangement, cooling is generally not required.

An optical fiber network 15 is shown directing ultraviolet light emitted by light source 7 to the irradiation zone 16 of duct/stack 1, with one end of the fiber lead placed at the light source 7 and the other end of the fiber lead placed in the duct/stack 1. Preferably, the optical fiber network comprises a material, such as one or more silica-based fibers, which provide minimal losses in the UV region (about 300–400 nm) and high thermal stability. Although not shown in FIG. 3, optical coupling may also be accomplished through use of a focusing lens, reflective materials, or similar techniques known to produce, transmit, and direct light. Any method of optical coupling known to those skilled in the art may be used to link the light source 7 to the duct/stack 1.

The remote arrangement shown in FIG. 3 provides easy cleaning and maintenance, and replacement as necessary. It may also be desirable to use a purged-air system (not shown) to maintain the light source 7 (e.g. lamps) or the optical fiber network 15, either on a continuous or periodic basis.

Since system 200 reduces the formation of undesirable secondary reactions and particulate matter, the need for other processing steps is advantageously eliminated. Physical methods such as scrubbers, temperature control, electrostatic precipitators and the like are generally unnecessary. It is also unnecessary to add other chemicals which facilitate precipitation or reduction of the pollutants by other mechanisms. While there can be some formation of ozone, ozone is unstable at the temperatures contemplated and is expected to break down; thus production of ozone is not expected to be a significant problem. Similarly, recombination of NO and O to form $NO_2$ is not expected to be a problem because the concentrations of NO and O will be very low; thus the likelihood of recombination is also very low.

Test results have shown that there is a strong relationship between the intensity of the illumination source 7 (as measured in wafts) and the decomposition rate of $NO_2$. Higher intensities provide more rapid decomposition of the $NO_2$. When plotted, the results show a log-linear relationship between $NO_2$ concentration and time. Quantum efficiency (the number of photons required per molecule of $NO_2$ dissociated) peaks at 390 nm. Thus, wavelengths much longer than this will not have sufficient energy to cause dissociation, while shorter wavelengths will not be as efficient in causing the dissociation of NO and O.

The following example provides an estimate of lamp size requirements for a common exhaust, such as from a combustion turbine power plant. Using a gas flow of 25 kg/hour of $NO_2$ and the bond dissociation energy of 305 kJ/kg-mole:

25 kg/hour×kg–mole/46 kg×305,000 Joules/kg–mole×hr/3,600 sec=46 watts

Thus, a light source 7 having 46 watts of radiative power near 393 nm is the estimated minimum power required for illumination of an exhaust stack having a $NO_2$ flow rate of 25 kg/hour. Since most UV optical sources are not completely efficient in depositing all their radiative energy in such a narrow wavelength, additional power consumption to drive the illumination source is expected.

The rate of photo-dissociation of $NO_2$ to NO has been found to exhibit a weak temperature dependence with the dissociation rate being slightly accelerated for temperatures of 150° C. or more. Temperature may also play a role in the suitable wavelength for the irradiation source 7. For example, the light source appropriate for gases having temperatures over 25° C. may have a wavelength longer than 400 nm.

The rate of photo-dissociation is given by $$\frac{d[NO_2]}{dt} = -J_{NO2}[NO_2], \quad \text{(Eqn. 1)}$$

where the rate constant for photo-dissociation, $J_{NO2}$, is $$J_{NO2}=\int I(\lambda)\sigma(\lambda)\phi(\lambda)d\lambda \quad \text{(Eqn. 2)}$$

$I(\lambda)$ is the spectral intensity of the light source, and $\sigma$ and $\phi$ are the wavelength dependent absorption cross-section and quantum efficiency for dissociation, respectively. Equation (2) may be evaluated using the total light intensity, $I_0$, and the fractional spectral distribution of the light source, $F(\lambda)$, which are related by:

$$I(\lambda)=I_0F(\lambda) \text{ where } \int F(\lambda)d\lambda=1. \quad \text{(Eqn. 3)}$$

Then $$J_{NO2}=I_0\xi \text{ where } \xi=\int F(\lambda)\sigma(\lambda)\phi(\lambda)d\lambda, \quad \text{(Eqn. 4)}$$

and $\xi$ is a constant for a given lamp type, and would be expected to vary with the lamp materials, and design. The effects of chemistry on the effective rate of removal of $NO_2$ may be taken into account by introducing an empirically "chemistry factor" Y and redefining $J_{NO2}$:

$$J_{NO2}=I_0\xi Y. \quad \text{(Eqn. 5)}$$

The solution to Equation (1) is:

$$\frac{[NO_2]_f}{[NO_2]_i} = e^{-J_{NO2}t}, \quad \text{(Eqn. 6)}$$

where t denotes residence time, or the time that a volume of gas is irradiated. The volume may be stationary and the light turned on and off, or alternatively, the volume may move past a light source. Substituting Equation (5) for $J_{NO2}$ in Equation (6), an expression relating $NO_2$ removal to light intensity, chemistry factor, and residence time is obtained:

$$\ln\left(\frac{[NO_2]_f}{[NO_2]_i}\right) = -I_0\xi Yt. \quad \text{(Eqn. 7)}$$

$NO_2$ removal efficiency $\eta$ may be defined as $$\eta = 1 - \frac{[NO_2]_f}{[NO_2]_i}. \quad \text{(Eqn. 8)}$$

Light attenuation, an important element in determining the quantity of $NO_2$ dissociated, can be calculated from Beer's Law for absorption:

$$\frac{I(\lambda)}{I_0(\lambda)} = e^{-\sigma(\lambda)Cl}, \quad \text{(Eqn. 9)}$$

where $I_0$ is the incident light intensity, I is the intensity after traversing path length I, C is the concentration of absorbers (assumed spatially uniformity), and $\sigma$ is the absorption cross-section.

System 200 can be configured to reduce the presence of $NO_2$ by about 50%–90%, depending upon operational considerations. As a result, the concentration of $NO_2$ in exhaust gases may reduced to below 20 ppm and below 10 ppm, or even less, thus increasing the mercury capture efficiency of the sorbent media in filter 12.

It should be understood that the examples and embodiments described herein are for illustrative purposes only and that various modifications or changes in light thereof will be suggested to persons skilled in the art and are to be included within the spirit and purview of this application. Accordingly, reference should be had to the following claims rather than to the foregoing specification as indicating the scope of the invention.

I claim:

1. A combustion-based system, comprising:

a combustor for burning a combustible material, wherein an exhaust gas stream output by said combustor includes $NO_2$ and at least one metal including mercury;

at least one ultraviolet light source in optical communication with said exhaust gas stream, ultraviolet light from said light source photo-chemically dissociating at least a portion of said $NO_2$ to form an $NO_2$ reduced exhaust stream, and a sorbent containing filter media for receiving said $NO_2$ reduced exhaust stream, said filter media trapping said at least one metal.

2. The system of claim 1, wherein said system comprises a fossil fuel fired power plant.

3. The system of claim 1, wherein said combustible material comprises coal.

4. The system of claim 1, wherein said system comprises a waste incinerator.

5. The system of claim 1, wherein said mercury in said exhaust stream is in the vapor phase.

6. The system of claim 1, further comprising a particle collection device for trapping said sorbent.

7. The system of claim 1, wherein said ultraviolet light source provides light in a wavelength range of 350 to 400 nm.

8. The system of claim 1, wherein said system reduces an amount of $NO_2$ in said exhaust gas to below 20 parts per million.

9. The system of claim 1, wherein said system reduces an amount of $NO_2$ in said exhaust gas to below 10 parts per million.

10. The system of claim 1, wherein said system is exclusive of catalyst particles.

11. The system of claim 1, wherein said sorbent media comprises activated carbon.

12. The system of claim 1, wherein said light source is disposed in said exhaust gas stream.

13. The system of claim 1, wherein said light source is disposed remote from said exhaust stream.

14. The system of claim 13, wherein a optical fiber network transmits said ultraviolet light to said exhaust stream.

15. The method of claim 14, wherein said ultraviolet light is in a wavelength range of 350 to 400 nm.

16. The method of claim 14, wherein said exhaust gas stream is generated by combusting coal.

17. A method for reducing mercury emissions from combustion-based systems, comprising the steps of:

irradiating an exhaust gas stream including mercury and $NO_2$ with ultraviolet light, said light photo-chemically dissociating at least a portion of said $NO_2$ to form an $NO_2$ reduced gas stream, and contacting said $NO_2$ reduced gas stream with a sorbent material, wherein said sorbent traps said mercury.

* * * * *